United States Patent [19]

Ullven

[11] 4,194,253

[45] Mar. 25, 1980

[54] PERSON-LIFTING DEVICE

[76] Inventor: Adolf G. Ullvén, Edingsvagen 1, 45100 Uddevalla, Sweden

[21] Appl. No.: 905,517

[22] Filed: May 12, 1978

[30] Foreign Application Priority Data

May 16, 1977 [SE] Sweden ..... 7705683

[51] Int. Cl.[2] ..... A61G 7/10

[52] U.S. Cl. ..... 5/84; 5/81 R

[58] Field of Search ..... 5/81, 83–85

[56] References Cited

U.S. PATENT DOCUMENTS

| | | | |
|---|---|---|---|
| 1,914,171 | 6/1933 | Scheidegger | 5/84 |
| 2,050,269 | 8/1936 | Brooks | 5/84 |
| 2,565,536 | 8/1951 | Valentine | 5/84 |
| 4,092,748 | 6/1978 | Ewers | 5/85 |

*Primary Examiner*—Casmir A. Nunberg

[57] ABSTRACT

A lifting device for a person confined to a bed, including a vertically movable lifting element in the shape of a stiff yoke to extend transversely of the person, the yoke having a neck portion to extend above the person and ending in two opposite spaced corners which two spaced portions extend downwardly on opposite sides of the person. The spaced portions are provided with brackets opening upwardly. The lifting device also includes a sheet-like carrying element for supporting the person, such element having two opposite ends with border hems and two bars respectively passing through the hems and being detachably received in the brackets.

6 Claims, 3 Drawing Figures

PERSON-LIFTING DEVICE

The present invention relates to a person-lifting device preferably of the kind intended for the lifting up of persons confined to bed.

It is a principal object of the invention to provide a lifting device of the kind mentioned above, which is cheap to manufacture and therefore can be available for every bed, where a need of such a lifting device does exist. It is likewise an object to provide such a lifting device as is simple to use and by means of which the patient in a considerate and comfortable manner can be kept at a convenient height above the bed and above a basin placed on the bed, and which device facilitates all other nursing activity for the patient. It is also an object to provide a device, by means of which the patient in a condition, in which he is lifted up above the bed, can be comfortably moved aside from the bed for example when the bed has to be made.

Figure 1:
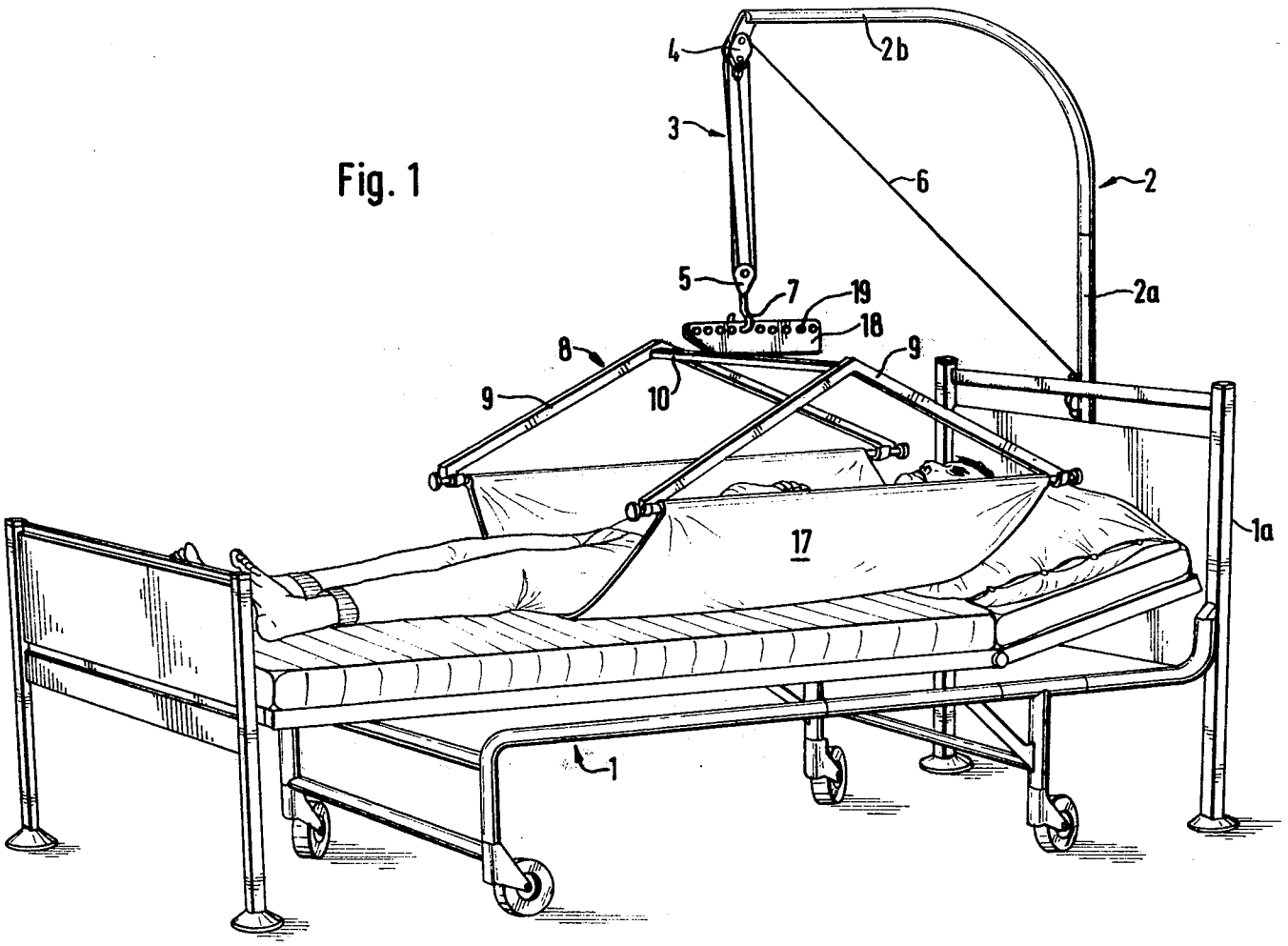
Figure 2:
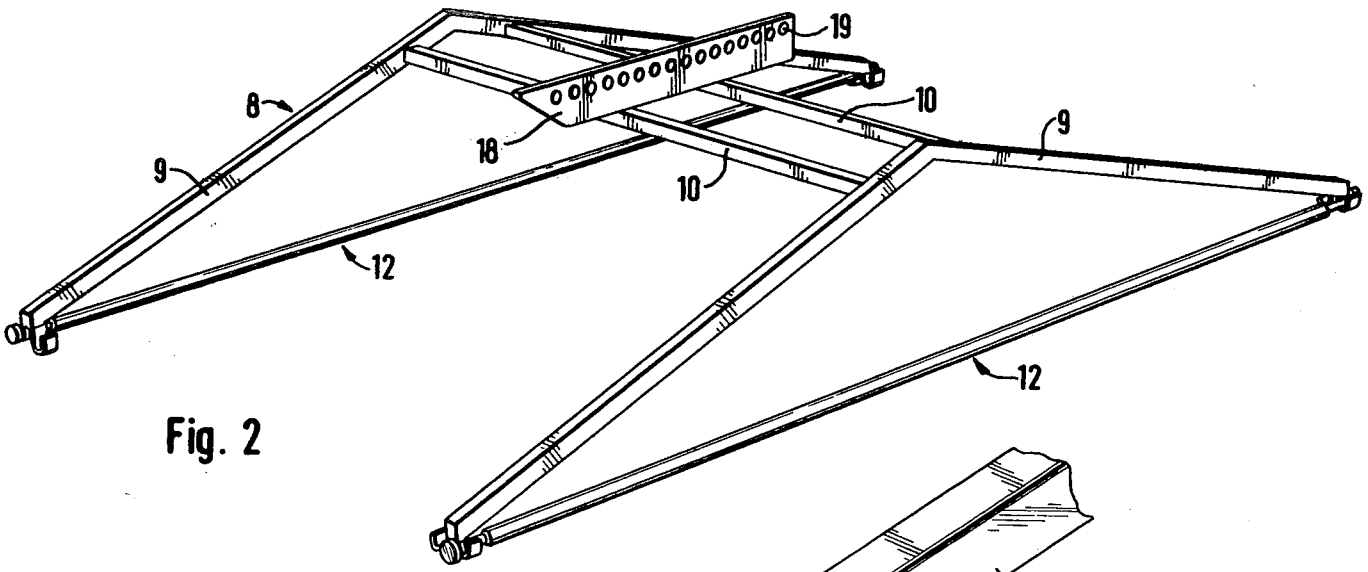
Figure 3:
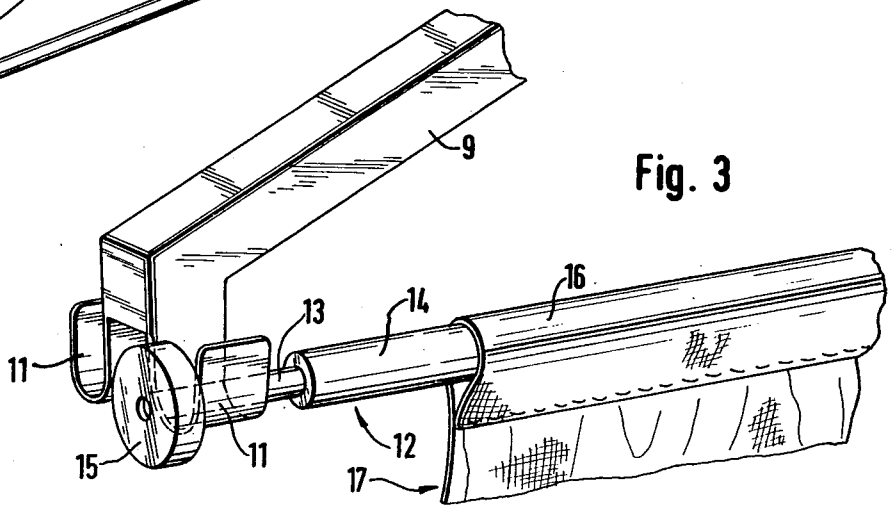

In the following an example an embodiment of the invention is described, reference being made to the accompanying drawings, in which FIG. 1 is a perspective view of a sick-bed as seen from above at an oblique angle and provided with a patient lifting device according to the invention, the lifting device being in the position, when it is ready to lift up the patient from the bed, FIG. 2 is a perspective view showing a detail of the lifting device on an enlarged scale, and FIG. 3 is a perspective view corresponding to the one of FIG. 2 and illustrating a portion of the lifting device on a still further enlarged scale.

In FIG. 1 a sick bed, which can be of an in itself known type, is a whole indicated with 1. At the end 1*a* of the bedstead a vertical lifting bar 2 bent in the form of an arc is provided, which bar has a leg portion 2*a*, pivoted on the end of the bedstead, and an upper horizontal leg portion 2*b*. A pulley block suspended at the free end of the leg 2*b* is as a whole indicated with 3, an upper tackle of said pulley block being indicated with 4 and a lower tackle with 5. The pull rope of the block is indicated with 6. It is of course possible within the scope of the invention to provide other types of power means. The lower tackle 5 is provided with a hook 7, which in a detachable manner can be hooked on to a lifting frame 8. The lifting frame 8 comprises two parallel frame parts 9 located at a certain distance from each other, said frame parts being bent into the shape of a ridge type roof and connected to each other by means of two additional frame parts 10 located on each side of the ridge. The lower ends of the two frame parts 9 are designed with sidewise extending brackets 11 on each side of the respective frame piece. A carrying bar 12 extends between the two end portions of each one of the frame parts 9 and comprises a core 13 of comparatively high-resistant material and a sleeve 14 threaded on said core between the brackets 11, which sleeve suitably can be of knurled rubber or plastics. The extreme end of the core 13 supports a terminal disc 15, which is suitably of the detachable kind. The two bars 12 are passed through opposing border hems 16 of a lifting bedsheet 17, which can be left in the bed, when the lifting device is not in use, suitably with the bars 12 introduced into the hems, which then results in a certain weight being given to the edge portions of the bed-sheet, so that they will hang down along the sides of the bedstead thereby contributing to the bed-sheet being in a fairly straightened out condition and impeding its movement. A plate extending in the vertical plane in substantially parallel direction to the frame parts 9 and attached to the frame part 10 is indicated with 18 and is at its upper edge provided with a number of interspaced holes 19 in order to permit the hook 7 to be hooked on in a desired position in the longitudinal extension of the bedstead, so that it is possible to choose a lifting point adapted to the gravity point of the patient to be lifted up. It is of course possible within the scope of the invention to substitute the holes 19 by other means for an optional attachment of the carrying means 7. By way of example the coupling can be of such a design that the carrying means itself can be displaced in the longitudinal direction of the bedstead. The lifting-up operation of the patient can suitably take place by moving the yoke-like carrying frame 8 being lowered down above the patient, whereafter the bars 12 are placed in the terminal brackets 11 of the frame parts 9 and the lifting-up is carried out by pulling of the rope 6, as is shown in FIG. 1. When the patient is to be placed on top of a basin, it is suitable to place the lifting bed-sheet 17 in a position somewhat closer to the head-end of the bedstead, and in relation to the lifting yoke 8 to move the hook 7 in the corresponding direction towards the foot-end. With the position of the lifting bed-sheet according to the drawing there exists the possibility to lift up the patient from the bed and pivot him in sidewise direction outside of the bedstead, something that can be of advantage in connection with the bed making operation.

The invention is not limited to the embodiment described above and illustrated in the drawing by way of example only, which embodiment can be varied as to its details without therefore departing from the fundamental idea of the invention.

I claim:

1. A lifting device, especially for use in connection with the care of a person confined to a bed, comprising: a vertically movable lifting element in the shape of a stiff yoke to extend transversely to the person, said yoke having a mid portion to extend above the person and ending in two opposite spaced corners, two spaced portions respectively extending downwardly from said two corners to extend on opposite sides of the person, said spaced portions being provided with brackets opening upwardly, a sheet-like carrying element for supporting the person during lifting, said element having two opposite ends with border hems, and two bar-shaped coupling means respectively passing through said hems, said coupling means having ends extending beyond said border hems and detachably received in said brackets, whereby said bar-shaped coupling means may be lifted out of said brackets.

2. A lifting device according to claim 1, wherein said yoke has a point of suspension which is displaceable in longitudinal direction of the person.

3. A lifting device according to claim 1 or 2, comprising a substantially horizontally projecting arm for suspending said lifting element, and means for pivotally connecting said projecting arm to a bed.

4. A lifting device according to claim 3, comprising power means extending between said arm and said yoke for lifting and lowering said lifting element.

5. A lifting device according to claim 1, comprising a soft friction- increasing material covering said coupling means where the same pass through said hems.

6. A lifting device according to claim 1, wherein the length of said sheet-like carrying element is shorter than the length of the person to be lifted.

* * * * *